US005496674A

United States Patent [19]

Adel et al.

[11] Patent Number: 5,496,674

[45] Date of Patent: Mar. 5, 1996

[54] PARTICLES SUITABLE AS CARRIERS FOR ELECTROPHOTOGRAPHY

[75] Inventors: Joerg Adel, Ludwigshafen; Norbert Mronga, Dossenheim, both of Germany; Erwin Czech, Kobe, Japan

[73] Assignee: BASF Aktiengesellschaft, Ludwigshafen, Germany

[21] Appl. No.: 244,712

[22] PCT Filed: Dec. 5, 1992

[86] PCT No.: PCT/EP92/02819

§ 371 Date: Jun. 13, 1994

§ 102(e) Date: Jun. 13, 1994

[87] PCT Pub. No.: WO93/12470

PCT Pub. Date: Jun. 24, 1993

[30] Foreign Application Priority Data

Dec. 12, 1991 [DE] Germany ..... 41 40 900.0

[51] Int. Cl.[6] ..... G03G 7/113

[52] U.S. Cl. ..... 430/106.6; 430/108; 430/137; 428/404; 427/127

[58] Field of Search ..... 430/106.6, 108, 430/137; 428/404; 427/127

[56] References Cited

U.S. PATENT DOCUMENTS

| | | | |
|---|---|---|---|
| 3,440,085 | 4/1969 | Baker et al. | 428/404 |
| 4,111,823 | 9/1978 | Kobayashi et al. | 430/110 |
| 4,345,013 | 8/1977 | Diamond et al. | 430/106.6 |
| 4,882,224 | 11/1989 | Moro et al. | 428/403 |
| 4,917,952 | 4/1990 | Katamoto et al. | 428/404 |
| 4,925,762 | 5/1990 | Ostertag et al. . | |
| 5,037,705 | 8/1991 | Weber et al. | 428/404 |
| 5,039,559 | 8/1991 | Sang et al. | 427/127 |
| 5,039,587 | 8/1991 | Czech et al. | 430/108 |
| 5,093,201 | 3/1992 | Ohtani et al. | 430/108 |
| 5,135,832 | 8/1992 | Sacripante et al. | 430/106.6 |

FOREIGN PATENT DOCUMENTS

| | | | |
|---|---|---|---|
| 177276 | 4/1986 | European Pat. Off. . | |
| 303918 | 2/1989 | European Pat. Off. . | |
| 359041 | 8/1989 | European Pat. Off. . | |
| 434669 | 6/1991 | European Pat. Off. . | |
| 59-127057 | 7/1984 | Japan | 430/106.6 |
| 59-131942 | 7/1984 | Japan | 430/106.6 |
| 59-127058 | 7/1984 | Japan | 430/106.6 |
| 2149525 | 6/1985 | United Kingdom . | |

OTHER PUBLICATIONS

Derwent Publication AN 88–253416 (Jul. 1988).
Derwent Publication AN 88–253426 (Jul. 1988).

*Primary Examiner*—Christopher D. Rodee
*Attorney, Agent, or Firm*—Oblon, Spivak, McClelland, Maier & Neustadt

[57] ABSTRACT

Particles (I) which are suitable as carriers for electrophotography consist of a) a magnetic core and b) a shell of alumina, chromium oxide, molybdenum oxide, tungsten oxide, silica, tin oxide or zirconium oxide or a mixture thereof and particles (II) consist of a) a magnetic core and b) a shell of titanium oxide and are obtainable by decomposing a titanium tetraalcoholate in the gas phase by reaction with steam and/or oxygen in the presence of agitated cores, and these particles are used in electrophotographic two-component developers.

10 Claims, No Drawings

PARTICLES SUITABLE AS CARRIERS FOR ELECTROPHOTOGRAPHY

The present invention relates to novel particles (I) which are suitable as carriers for electrophotography and consist of a) a magnetic core and b) a shell of alumina, chromium oxide, molybdenum oxide, tungsten oxide, silica, tin oxide or zirconium oxide or a mixture thereof.

The present invention also relates to further novel particles (II) which are suitable as carriers for electrophotography and consist of a) a magnetic core and b) a shell of titanium oxide, obtainable by decomposing a titanium tetraalcoholate in the gas phase by reaction with steam and/or oxygen in the presence of agitated cores.

The present invention furthermore relates to processes for the preparation of these particles and their use for the preparation of electrophotographic two-component developers, and electrophotographic two-component developers which contain these particles.

Two-component developers are used in electrophotographic copiers and laser printers for developing an electrophotographically produced latent image and usually consist of carrier particles and toner particles. The carrier particles are magnetizable particles having sizes of, as a rule, from 20 to 1,000 μm. The toner particles consist essentially of a color-imparting component and binder and have a size of about 5–30 μm.

In the copying process, the electrostatic, latent image is produced by selective exposure of an electrostatically charged photoconductor roller to light reflected from the original. In the laser printer, this is effected by a laser beam.

For the development of the electrostatic image, toner particles are transported to the photoconductor roller by means of a magnetic brush, i.e. carrier particles oriented along the field lines of a sector magnet. The toner particles adhere through electrostatic attraction to the carrier particles and, during transport in the magnetic field, acquire an electrostatic charge opposite to that of the carrier particles, as a result of friction. The toner particles thus transferred from the magnetic brush to the photoconductor roller give a toner image which is then transferred to electrostatically charged paper and fixed.

The carrier particles used have to meet a number of requirements: they should be magnetizable and thus permit a rapid build-up of the magnetic brush. Furthermore, their surface should have low conductivity in order to prevent a short-circuit between the sector magnet and the photoconductor roller. This conductivity should remain constant over long operating times of the carrier so that the triboelectric charge of the developer can also be kept constant for a long time. Not least, the carrier particles should also be free-flowing and should not form lumps in the developer storage vessel.

In order to meet these requirements, the carrier particles consisting of magnetically hard or in particular magnetically soft material must as a rule be coated.

EP-A-303 918 discloses the coating of steel and ferrite carriers with iron oxide or titanium dioxide which is precipitated by oxidative or hydrolytic decomposition of iron pentacarbonyl or titanium tetrachloride from the gas phase onto the carrier particles.

It is also generally known that the surface of the carrier particles can be coated with polymers, in particular polymeric fluorocarbons, or the surface of metallic carrier particles can be passivated by oxidation.

However, the last-mentioned coating methods in particular have many disadvantages. Constant and sufficiently thick layers are difficult to produce and in addition polymer-coated carriers exhibit poor adhesion of the polymer layer to the carrier surface and therefore have only a short life.

It is an object of the present invention to provide novel carriers for electrophotography which possess advantageous performance characteristics, and hence to make it possible to achieve optimum matching of the carrier with the particular toner used.

We have found that this object is achieved by particles (I) which are suitable as carriers for electrophotography and consist of a) a magnetic core and b) a shell of alumina, chromium oxide, molybdenum oxide, tungsten oxide, silica, tin oxide or zirconium oxide or a mixture thereof.

We have furthermore found a process for the preparation of the particles (I), wherein volatile aluminum, chlorine, molybdenum, tungsten, silicon, tin and/or zirconium compounds are decomposed by reaction with steam and/or oxygen in the gas phase in the presence of agitated cores.

We have also found novel particles (II) which are suitable as carriers for electrophotography and consist of a) a magnetic core and b) a shell of titanium oxide, obtainable by decomposing a titanium tetraalcoholate in the gas phase by reaction with steam and/or oxygen in the presence of agitated cores, and the process, defined thereby, for the preparation of the particles (II).

We have furthermore found the use of the particles (I) and (II) for the preparation of electrophotographic two-component developers, and electrophotographic two-component developers which contain the particles.

The cores of the novel particles (I) and (II) which are suitable as carriers for electrophotography may consist of the conventional magnetically soft materials, such as iron, steel, magnetite, ferrites (for example nickel/zinc, manganese/zinc and barium ferrites), cobalt and nickel, and particles of these metals or metal compounds which are embedded in polymer resins conventionally used for this purpose. Also suitable are magnetically hard materials such as strontium ferrite or barium ferrite or neodymium iron borides.

The cores may additionally be coated with iron oxide and/or titanium oxide or a mixture thereof in the case of the carriers (I) and with iron oxide in the case of the carriers (II). This type of coating is described in the abovementioned EP-A-303 918.

The novel metal oxide shells of the carrier cores (I) and (II) consist mainly of the following oxides: alumina ($Al_2O_3$), chromium(III) oxide ($Cr_2O_3$), molybdenum(VI) oxide ($MoO_3$), tungsten(VI) oxide ($WO_3$), silica ($SiO_2$), tin dioxide ($SnO_2$) and zirconium dioxide ($ZrO_2$) and, in the case of the carriers (II), titanium dioxide ($TiO_2$). Further oxides of the metals in other oxidation states and basic oxides are present as a rule in not more than small amounts, depending on the method of preparation. The oxide shell of the carriers (I) may also consist of mixtures of the stated oxides which have been deposited in succession or simultaneously, and of mixed oxides.

The thickness of the oxide shell is not in itself critical. In principle both very thin and very thick layers are possible. The optimum thickness of the oxide shell is dependent on the particular intended use. As a rule, it is from about 2 to 500 nm, preferably from 10 to 200 nm.

For the formation of the oxide shell, in the novel processes for the preparation of the carriers (I) and (II) volatile compounds of the corresponding metals are decomposed hydrolytically and/or oxidatively in the gas phase in the presence of the carrier cores to be coated (chemical vapor deposition).

The corresponding carbonyls, halides and alcoholates are preferably used.

The chlorides are particularly preferred in the case of the halides, but the bromides and iodides can also be used, for example aluminum tribromide.

The alcoholates may be both aromatic and aliphatic compounds. For example, phenolates and benzyl alcoholates and especially $C_1$–$C_4$-alkanolates, such as methanolates, ethanolates, n- and isopropanolates and n-, tert- and isobutanolates, are particularly preferred here.

Very particularly preferred starting compounds are chromium hexacarbonyl, molybdenum hexacarbonyl and tungsten hexacarbonyl, aluminum trichloride and silicon tetracholride, tin tetrachloride and zirconium tetrachloride.

In the novel preparation of the carriers (II) coated with titanium oxide, essentially titanium dioxide, titanium tetraalcoholates, such as titanium tetraphenolate, titanium tetrabenzyl alcoholate and titanium tetra-$C_1$–$C_4$-alkanolates, e.g. titanium tetramethanolate, ethanolate, n-propanolate, n-, iso- and tert-butanolate and preferably titanium tetraisopropanolate, are used.

The decomposition of the carbonyls is preferably effected by oxidation with oxygen or air, while the halides and alcoholates are preferably decomposed by hydrolysis with steam in the presence or absence of oxygen. The alcoholates and halides may also be decomposed oxidatively, but higher temperatures (from about 200° to 600° C.) are required for this purpose, particularly in the case of the halides. As a rule, only heat-stable cores, such as steel or ferrite cores, are therefore suitable for coating carried out in this manner.

The following process is advantageously used: The carrier cores are first fluidized in a heatable reaction vessel, preferably in an agitated fixed bed or a fluidized bed, by means of an inert gas, such as nitrogen, and are heated to, as a rule, from 100° to 400° C. preferably from 200° to 300° C. The vaporized metal compound as a mixture with an inert gas, such as nitrogen, and the particular reactant, either air or another oxygen/nitrogen mixture for oxidation, or steam with a carrier gas, such as nitrogen or air, for hydrolysis are then fed in separately. The concentration of oxygen, steam and especially the metal compound in the particular carrier gas should preferably be less than about 5% by volume in order to ensure uniform coating of the carrier surface with metal oxide.

The thickness of the metal oxide layer formed depends of course on the metal compound fed in and can thus be controlled via the coating time.

After cooling, the product can then be discharged and can be used without further aftertreatment.

Coating of the carrier cores by means of the gas phase decomposition of corresponding metal compounds is the preferred procedure for the preparation of the novel carriers. In principle, however, this can also be effected by precipitating the metal oxide or hydroxide from an aqueous metal salt solution or from an organic solvent, followed by the heat treatment.

The novel carriers have homogeneous, abrasion-resistant metal oxide layers. Their surface has the desired low conductivity. Depending on the particular toner used, they permit both a positive and a negative toner charge and can therefore be specifically selected for the intended use. Moreover, they have a long life and can therefore generally be advantageously used with the commercial toners for the preparation of electrophotographic two-component developers.

EXAMPLES

A. Preparation of novel carriers

The crude carriers were coated in an agitated fixed bed. The reaction vessel used was a 500 ml quartz flask having a diameter of 10 cm and was fastened to a rotary evaporator. A thermostatable metal nozzle which contained two separate water-cooled gas inlet tubes and a thermocouple with a gas-tight seal was introduced through the motor shaft of the rotary evaporator into the center of the carrier bed in the flask. The quartz flask was heated by means of a 6 l heating jacket. The metal compound vaporized in an evaporator vessel upstream of the nozzle was fed, in a stream of nitrogen, through an inlet tube. The second inlet tube was used for the introduction of nitrogen and of air for oxidation or of air laden with steam in a further upstream evaporator vessel.

In the apparatus described above, x kg of the crude carrier

A: spherical steel carrier having a mean particle size of from 75 to 180 μm, type TC 100 (Pometon S.p.A., Italy), B: ferrite carrier having a mean particle size of from 45 to 105 μm, type KBN 100 (Hitachi, Japan) or C: ferrite carrier having a mean particle size of from 20 to 60 μm, CM 30–60 SH (Höganäs, Sweden) were heated to 250° C. at 50 rpm in a stream of 40 l/h of nitrogen. y g (ml) of metal compound in a stream of n l/h of nitrogen were passed into the apparatus in d h via the evaporator vessel heated to the evaporation temperature V [° C.]. In addition, s l/h of air for oxidation or, via the second evaporator vessel heated to 20° C., steamladen air (w l/h) for hydrolysis were additionally fed in.

The carrier coated in this manner was then cooled under a stream of 50 l/h of nitrogen and was discharged.

Details of the experiments and their results are summarized in Table 1.

TABLE 1

| Example | x kg of crude carrier | | y g of metal compound | | Evaporation temperature V [°C.] | n l/h of nitrogen | d h Evaporation time | s l/h of air | w l/h of water/air | Metal content of coated carrier % by weight |
|---|---|---|---|---|---|---|---|---|---|---|
| 1 | 1.8 | A | 10 | $W(CO)_6$ | 80 | 50 | 20 | 50 | — | W: 0.20 |
| 2 | 1.8 | A | 10 | $Cr(CO)_6$ | 80 | 40 | 22 | 50 | — | Cr: 0.17 |
| 3 | 1.8 | A | 10 | $Mo(CO)_6$ | 80 | 50 | 15 | 50 | — | Mo: 0.14 |
| 4 | 1.5 | A | 10* | $SiCl_4$ | –40 | 20 | 7 | — | 20 | Si: 0.59 |
| 5 | 1.8 | A | 6.5* | $SnCl_4$ | 9 | 10 | 12 | — | 10 | Sn: 0.05 |
| 6 | 1.5 | A | 3.5 | $AlCl_3$ | 150 | 100 | 7 | — | 10 | Al: 0.05 |
| 7 | 1.0 | B | 10 | $W(CO)_6$ | 80 | 50 | 20 | 50 | — | W: 0.47 |
| 8 | 1,0 | B | 10 | $Cr(CO)_6$ | 80 | 40 | 22 | 50 | — | Cr: 0.22 |
| 9 | 1.0 | B | 10 | $Mo(CO)_6$ | 80 | 50 | 15 | 50 | — | Mo: 0.38 |
| 10 | 1.0 | B | 10* | $SiCl_4$ | –40 | 20 | 7 | — | 20 | Si: 0.08 |
| 11 | 1.0 | B | 6.5* | $SnCl_4$ | 9 | 10 | 12 | — | 10 | Sn: 0.01 |
| 12 | 1.0 | B | 3.5 | $AlCl_3$ | 150 | 100 | 7 | — | 10 | Al: 0.06 |
| 13 | 1.0 | C | 7* | $Ti(i\text{-}OC_3H_7)_4$ | 170 | 20 | 2 | — | 50** | Ti: 0.10 |

TABLE 1-continued

| Example | x kg of crude carrier | y g of metal compound | Evaporation temperature V [°C.] | n l/h of nitrogen | d h Evaporation time | s l/h of air | w l/h of water/air | Metal content of coated carrier % by weight |
|---|---|---|---|---|---|---|---|---|
| 14 | 1.8 A | 1.4 $Mo(CO)_6$ | 80 | 80 | 2 | 50 | — | Mo: 0.02 |

* = ml
** = Water heated to 40° C.

B. Measurement of the electrical resistance and of the electrostatic charge capacity of novel carriers B.1. Electrical resistance The electrical resistance of the carriers from Examples 1 to 14 is measured using the C meter from PES Laboratorium (Dr. R. Epping, Neufahrn). For this purpose, the carrier particles were agitated for 30 s in a magnetic field of 900 Gauβ at a voltage $U_0$ of 100 V (capacitance C=1 nF).

The resistance R can be calculated according to the following formula from the decrease of the voltage with time after the applied electric field has been switched off:

$$R=t/[C/\ln (U_0/U)]$$

where R is the resistance [ohm], t is time of the measurement [s],

C is the capacitance [F], $U_0$ is the voltage at the beginning of the measurement [V]and U is the voltage at the end of the measurement [V].

The resistance R is usually stated as logarithmic values. The results of the measurement are shown in Table 2.

B.2. Electrostatic charge capacity Q/M

The electrostatic charge capacity Q/M of the carriers from Examples 1 to 14 was determined against the following toners:

T1: Positively chargeable toner for the commercial Siemens ND 2/3 laser printer

T2: Negatively chargeable toner for the commercial IBM 3827 laser printer;

T3: Neutral toner without pigment and further additives: styrene/butyl acrylate resin (Neocryl● B 1062 toner resin; Polyvinylchemie, The Netherlands) milled in a laboratory pinned-disk mill to a mean particle size of 26.7 μm and sieved to give a fraction less than 36 μm.

For this purpose, the carrier particles were first mixed with the particular toner in a weight ratio of 98.5:1.5 and shaken in a glass vessel for 2 minutes. A weighed amount of this mixture was then introduced to a hard blow-off cell coupled to an electrometer (Q/M meter from PES Laboratorium, Dr. R. Epping, Neufahrn). The mesh size of the sieves used in the cell was 40 μm and was chosen so that no carriers were discharged but the toner powder could be completely blown off. When blowing off and extraction of the toner were complete, the charge was determined and was related to the weight of the blown-off toner by reweighing.

The results of the measurement are summarized in Table 2.

TABLE 2

| Example | Electrical resistance, expressed as log R [log ohm] | Electrostatic charge capacity Q/M [μC/g] T1 | T2 | T3 |
|---|---|---|---|---|
| 1 | 9.42 | +20.4 | −5.9 | +23.4 |

TABLE 2-continued

| Example | Electrical resistance, expressed as log R [log ohm] | Electrostatic charge capacity Q/M [μC/g] T1 | T2 | T3 |
|---|---|---|---|---|
| 2 | 8.12 | +22.1 | −12.0 | −18.8 |
| 3 | 8.21 | +20.1 | +13.3 | +24.9 |
| 4 | 9.60 | +11.5 | −4.3 | −1.0 |
| 5 | 9.41 | +44.3 | −1.0 | −1.2 |
| 6 | 9.90 | +22.4 | −9.7 | −2.2 |
| 7 | 10.58 | +15.2 | +3.6 | −1.9 |
| 8 | 8.42 | +11.8 | −3.0 | 0 |
| 9 | 9.53 | +15.1 | +6.0 | +2.0 |
| 10 | 10.22 | +7.5 | +3.8 | +2.9 |
| 11 | 10.47 | +8.5 | +5.0 | +1.8 |
| 12 | 10.40 | +14.2 | −0.7 | 0 |
| 13 | 10.90 | +10.7 | +1.0 | 0 |
| 14 | 8.15 | +25.4 | −7.1 | +0.9 |

We claim:

1. Carrier particles for electrophotography consisting of a) a magnetic core and b) a shell consisting of molybdenum oxide, tungsten oxide or a mixture thereof.

2. Carrier particles as claimed in claim 1, wherein the shell is molybdenum oxide.

3. Carrier particles as claimed in claim 1, wherein the shell is tungsten oxide.

4. Carrier particles as claimed in claim 1, wherein the magnetic core is iron, steel, magnetite, ferrite, cobalt, nickel or neodymium iron boride.

5. An electrophotographic two-component developer, comprising carrier particles consisting of a) a magnetic core and b) a shell consisting of molybdenum oxide, tungsten oxide or tin oxide or a mixture thereof, and toner particles.

6. The two-component developer as claimed in claim 5, wherein the shell of the carrier particles is molybdenum oxide.

7. The two-component developer as claimed in claim 5, wherein the shell of the carrier particles is tungsten oxide.

8. The two-component developer as claimed in claim 5, wherein the shell of the carrier particles is tin oxide.

9. A process for the preparation of carrier particles for electrophotography consisting of a) a magnetic core and b) a shell consisting of molybdenum oxide, tungsten oxide or a mixture thereof, consisting of decomposing a volatile metal compound selected from the group consisting of compounds of molybdenum, compounds of tungsten and a mixture thereof by reaction with steam or oxygen or both in the gas phase in the presence of heated, agitated magnetic core particles to thereby obtain said carrier particles.

10. A process as claimed in claim 9, wherein the volatile metal compounds are metal halides or metal carbonyls.

* * * * *